US009112319B2

(12) United States Patent
Liao et al.

(10) Patent No.: US 9,112,319 B2
(45) Date of Patent: Aug. 18, 2015

(54) MODULAR ELECTRICAL CONNECTOR MODULE

(71) Applicants: Wen-Yung Liao, New Taipei (TW); Wen-Fu Liao, New Taipei (TW); Sheng-Hsin Liao, New Taipei (TW)

(72) Inventors: Wen-Yung Liao, New Taipei (TW); Wen-Fu Liao, New Taipei (TW); Sheng-Hsin Liao, New Taipei (TW)

( * ) Notice: Subject to any disclaimer, the term of this patent is extended or adjusted under 35 U.S.C. 154(b) by 153 days.

(21) Appl. No.: 13/666,036

(22) Filed: Nov. 1, 2012

(65) Prior Publication Data

US 2013/0109219 A1 May 2, 2013

(30) Foreign Application Priority Data

Nov. 2, 2011 (TW) ..... 100140017 A

(51) Int. Cl.

| | |
|---|---|
| ***H01R 4/50*** | (2006.01) |
| ***H01R 13/74*** | (2006.01) |
| ***H01R 31/06*** | (2006.01) |
| ***H01R 33/94*** | (2006.01) |

(52) U.S. Cl.
CPC ..... *H01R 13/743* (2013.01); *H01R 31/065* (2013.01); *H01R 33/94* (2013.01)

(58) Field of Classification Search
CPC ..... H01R 13/6275; H01R 25/003
USPC ..... 439/345, 214, 490, 375
See application file for complete search history.

(56) References Cited

U.S. PATENT DOCUMENTS

| | | | | |
|---|---|---|---|---|
| 5,233,281 | A * | 8/1993 | Chiang et al. | 320/110 |
| 6,940,015 | B2 * | 9/2005 | Fang | 174/53 |
| 7,390,977 | B2 * | 6/2008 | Hill | 174/480 |

* cited by examiner

*Primary Examiner* — Phuongchi T Nguyen
(74) *Attorney, Agent, or Firm* — Li & Cai Intellectual Property (USA) Office

(57) ABSTRACT

A modular electrical connector module includes an outer panel, an outlet box and an interchangeable socket module. The interchangeable socket module has at least one connector and is disposed in the outlet box yet demountable. The interchangeable socket module is exposed to the exterior via an opening defined by the outer panel for easy maintenance accessibility.

8 Claims, 12 Drawing Sheets

MODULAR ELECTRICAL CONNECTOR MODULE

BACKGROUND

1. Field of the Invention

The instant disclosure relates to a modular electrical connector module; in particular, to a wall mounted electrical outlet module.

2. Description of Related Art

The conventional installation of electrical conduits in a building is often embedded in the wall. Only the receptacle portion is revealed from a front face to allow electrical connection. The demand of electrical connection increases significantly along with the wide spread of electrical products (for example, digital cameras, cell phones and personal digital assistants).

Frequent usage of electrical outlet receptacles may cause accelerated wear out due to frequent plugging and unplugging. However, receptacle maintenance or replacement usually requires the entire removal of the outlet box, which may temporarily cut off power supply or signal transmission and cause inevitable interruption.

SUMMARY OF THE INVENTION

The object of the instant disclosure is to provide a modular demountable/interchangeable electrical connector module for easier maintenance.

The modular electrical connector module comprises an outer panel, an outlet box covered by the outer panel and an interchangeable socket module including at least one connector. The interchangeable socket module is disposed in the outlet box yet demountable and the receptacle thereof is exposed partially via a outer panel opening. However, the outer panel is optional according to the desired intension.

The instant disclosure provides an integrated interchangeable socket module being physically independent from the outlet box, thus allowing easy access for socket maintenance or replacement.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

First Embodiment

Figure 1:
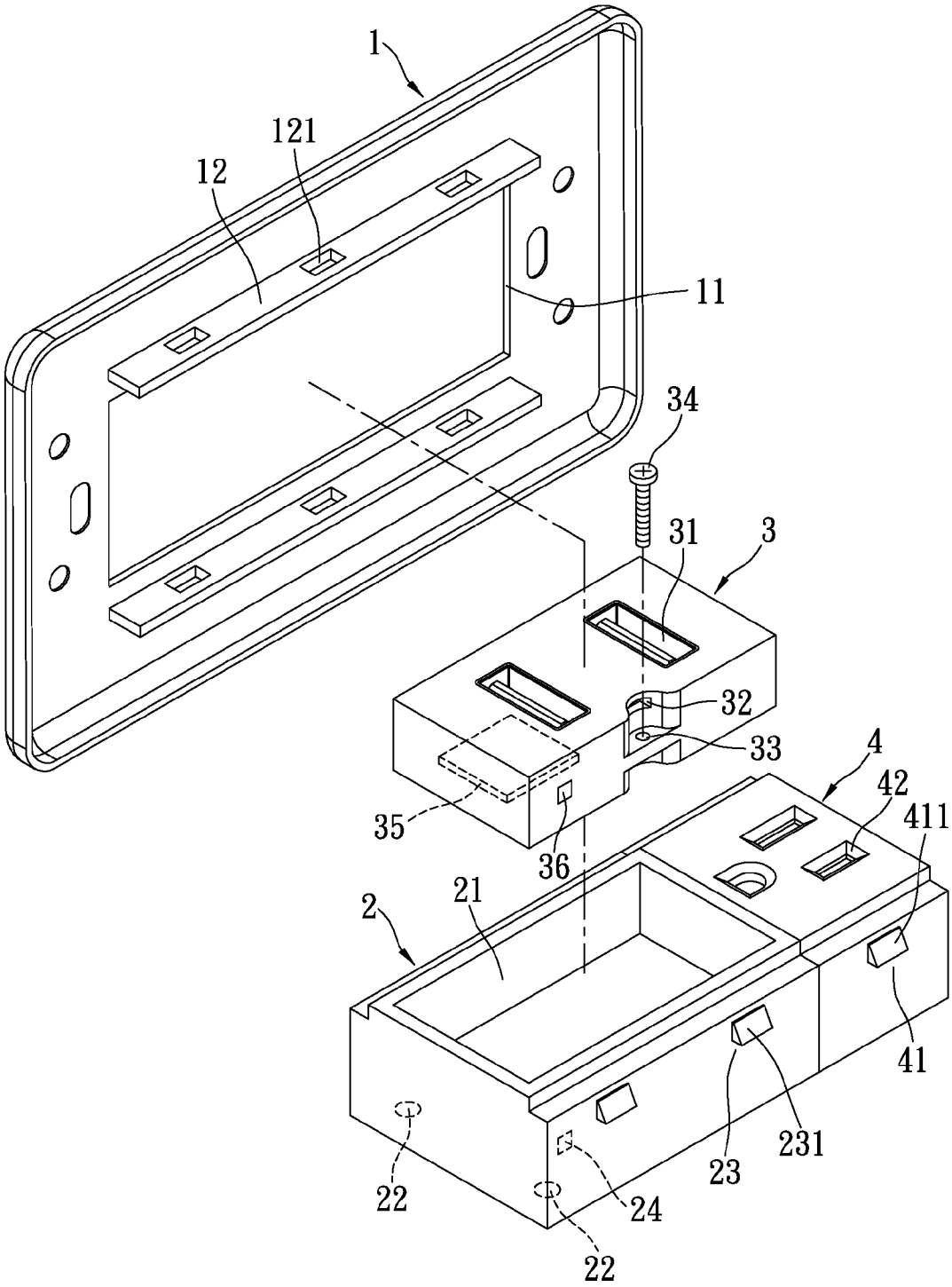
FIG. 1 illustrates an exploded view of a modular electrical connector module in accordance with a first embodiment of the instant disclosure.
Figure 2:
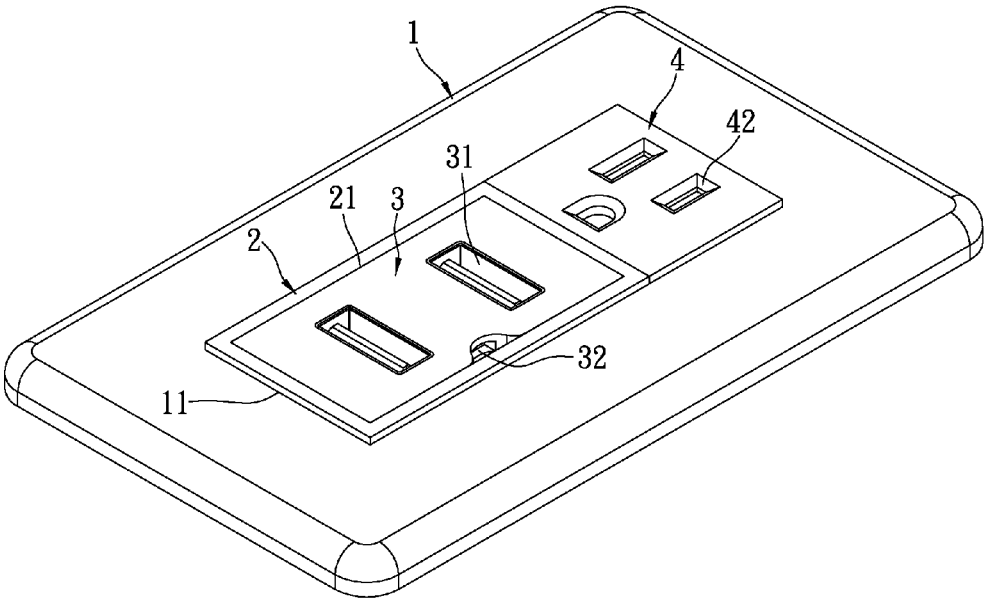
FIG. 2 illustrates a perspective view of a modular electrical connector module in accordance with a first embodiment of the instant disclosure.

Please refer to FIG. 1 in conjunction with FIG. 2. The instant disclosure provides a modular electrical connector module, which is applicable to a wide variety of receptacle standards and satisfies the requirement of ground fault circuit interrupter (GFCI). In the instant embodiment, a Taiwanese receptacle is taken as an example. The modular electrical connector module comprises a outer panel 1 defining an opening 11 in the centre portion, an outlet box 2 and an interchangeable socket module 3. The outer panel 1 is rectangular in the instant embodiment and the shape thereof is not limited thereto. In addition, the outer panel 1 may have more than one layer as long as the interchangeable socket module 2 is exposed conformingly to the opening 11. Furthermore, the outer panel 1 includes a first lock portion 12 extending toward the outlet box 2. The first lock portion 12 is formed with a plurality of lock apertures 121 for engagement with the outlet box 2.

The outlet box 2 is substantially rectangular having a fringe region surrounding the outline thereof and the interchangeable socket module 3 conformingly fits therein. The rear end of the outlet box 2 is formed with a wire passage 22 to admit bare wire terminals, which electrically connect to the outlet box 2 by a clamp (not shown in the figure) so the power passes thereby. The outlet box 2 engages with the first lock portion 12 of the outer panel 1 by a second lock portion 23, which is formed on either side of the outlet box 2 conforming to the first lock portion 12. In the instant embodiment, the second lock portion 23 has a plurality of lock protrusions 231, which fits into the lock apertures 121 and secures the outlet box 2 to the outer panel 1, and the structure thereof is not limited thereto.

In the instant embodiment, the interchangeable socket module 3 is rectangular and the shape thereof is not limited thereto. The interchangeable socket module 3 includes at least one connector 31 and the model is adaptable to a wide variety of standards. That is to say the connector 31 can be, for example, USB connector, IEEE 1394 connector, HDMI connector, AV terminals and DC terminals. The interchangeable socket module 3 is easily demountable from the outlet box 2 and is exposed to the exterior by the opening 11 for receiving plugs. The interchangeable socket module 3 may be retrieved directly from the outlet box 2 without removing the outer panel 1 if the dimension of the interchangeable socket module 3 is smaller than that of the opening 11.

The interchangeable socket module 3 is formed with a recess 32 and a fastening hole 33 for receiving a screw 34 to engage the interchangeable socket module 3 with the outlet box 2. When the interchangeable socket module 3 is disposed in the outlet box 2, the recess 32 helps to conceal the screws 34 and fastening hole 33 from the view of curious children/non-professional personnel, thus contributes to the prevention of unwanted access to the interior of the socket module, which may lead to accidents.

The interchangeable socket module 3 can be a charger having a charging circuit 35 embedded and electrically connected to the connector 31. The interchangeable socket module 3 includes a plurality of electric points 36 electrically connecting the charging circuit 35 as well as the connector 31 and serving as power inlet. The outlet box 2 includes a plurality of electrical contacts 24, which is arranged conformingly to the electrical contacts 36 and electrically contacts the clamp. The power and signals are transmitted via the electrical contacts 24, 36 to the interchangeable socket module 3 and the connector 31 servers as an outlet. The interchangeable socket module 3 may further include a power adapter, indicator or sensor.

The electrical connector module further comprises a conventional socket unit 4 including wire passages (not shown in the figure) for administration of the bare wire terminals. The terminals are fastened by the clamp (not shown in the figure) and the power is transmitted thereby to a receptacle 42 of the socket unit 4. The socket unit 4 also includes a third lock portion 41 on either side conforming to the first lock portion 12 for engagement. In the instant embodiment, the third lock portion 41 has two lock protrusions 411 corresponding to the lock apertures 121 and securing the socket unit 4 to the outer panel 1. The receptacle 42 is exposed to the exterior via the opening 11.

Second Embodiment

Figure 3:
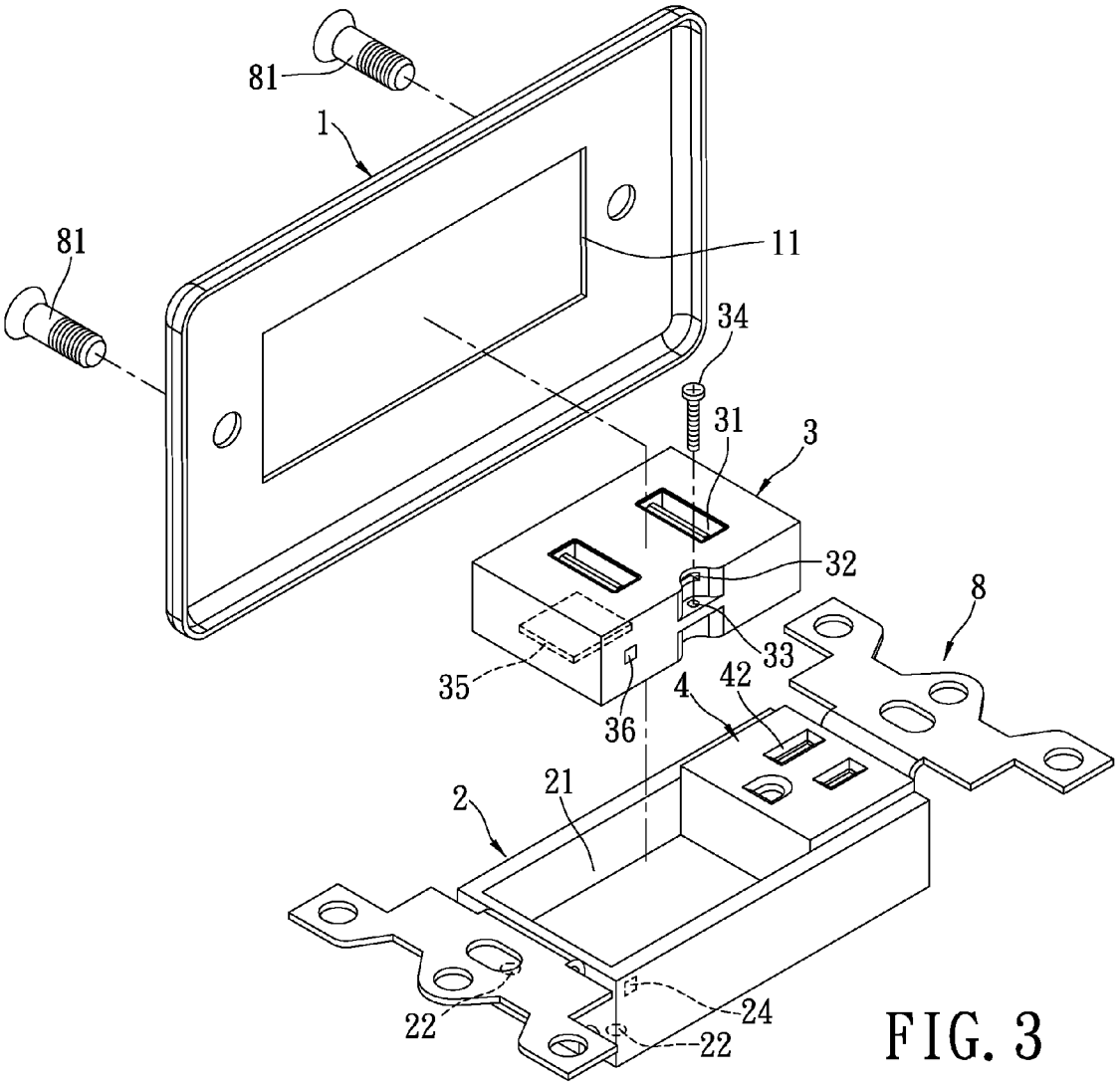
FIG. 3 illustrates an exploded view of a modular electrical connector module in accordance with a second embodiment of the instant disclosure.
Figure 4:
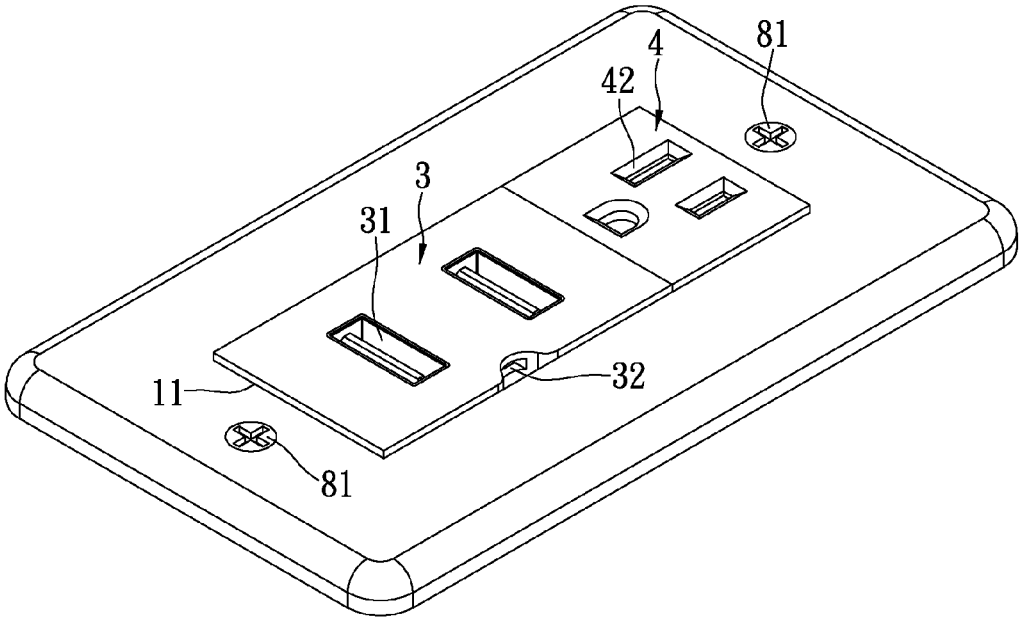
FIG. 4 illustrates a perspective view of a modular electrical connector module in accordance with a second embodiment of the instant disclosure.

Please refer to FIG. 3 in conjunction with FIG. 4. The instant disclosure illustrates an American standard socket. The difference between the first and second embodiments lies on the outlet box 2 and socket unit 4 being formed as a single member in the later case. The outlet box 2 and the socket unit 4 together combine with the outer panel 1 by a pair of bracket 8. The brackets 8 are like two wings and enable bolt fastening of the outlet box 2 along with socket unit 4 to the outer panel 1. The interchangeable socket module 3 is demountable from the outlet box 2 and the connector 31 is exposed to the exterior via the opening 11.

Third Embodiment

Figure 5:
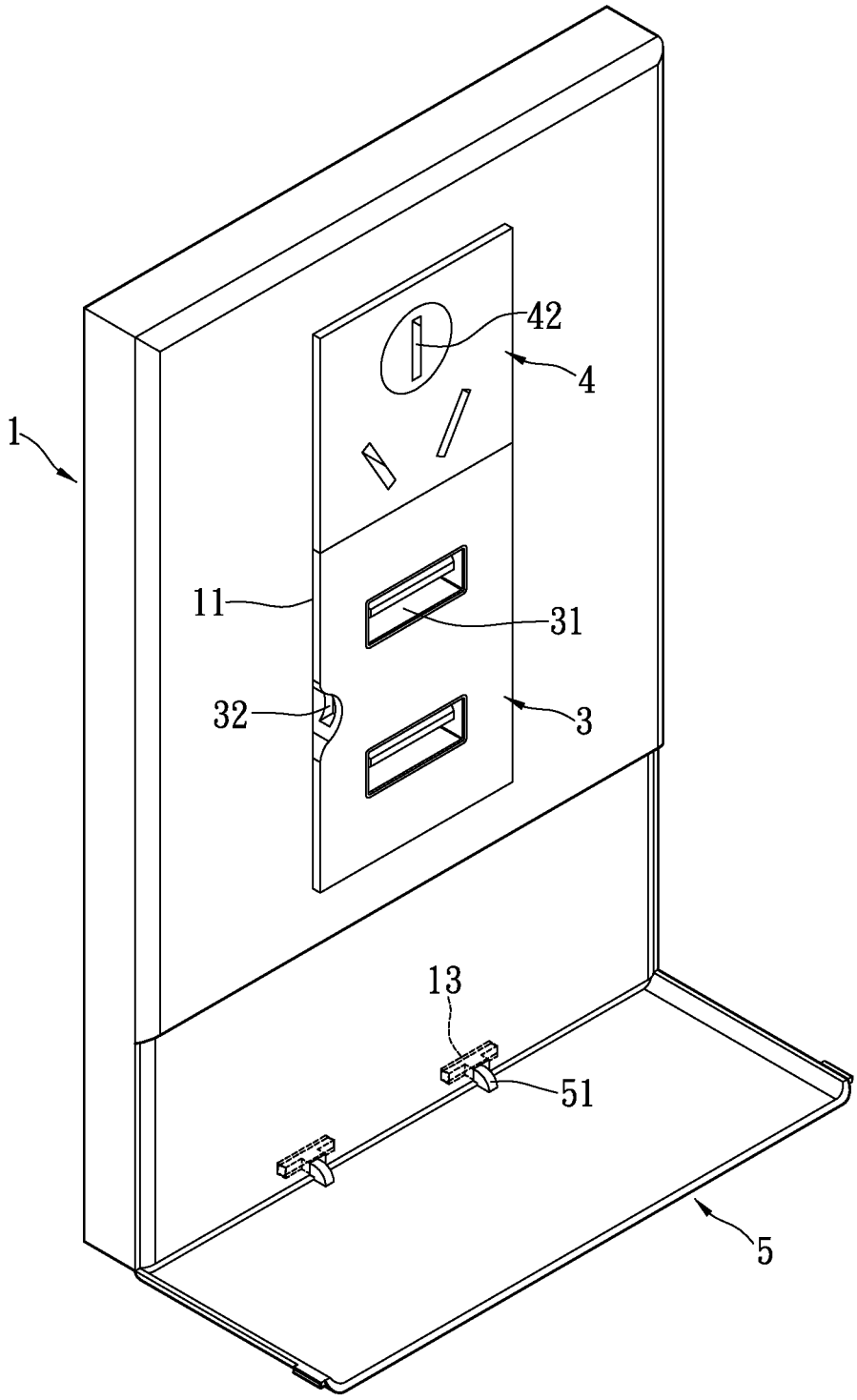
FIG. 5 illustrates a perspective view of a modular electrical connector module in accordance with a third embodiment of the instant disclosure.

Please refer to FIG. 5. In the instant embodiment, the outer panel 1 is in a different layout. The outer panel 1 includes two first pivot portions 13 being pivot holes and a carrying tray 5 connecting one edge of the outer panel 1. The carrying tray 5 includes two second pivot portions 51 being pivot pins. The carrying tray 5 connects the outer panel 1 via the flexible engagement between the first and second pivot portions 13, 51, and thus the carrying tray 5 is capable of flipping in relation to the outer panel 1. In an extended position, the carrying tray 5 flips out to allow placement of electronic products thereon. On the other hand, in a received position, the carrying tray 5 flips back to the same plane as the outer panel 1. Another difference arises from the connector 42 of the socket unit 4, which is different type of receptacle standard.

Fourth Embodiment

Figure 6:
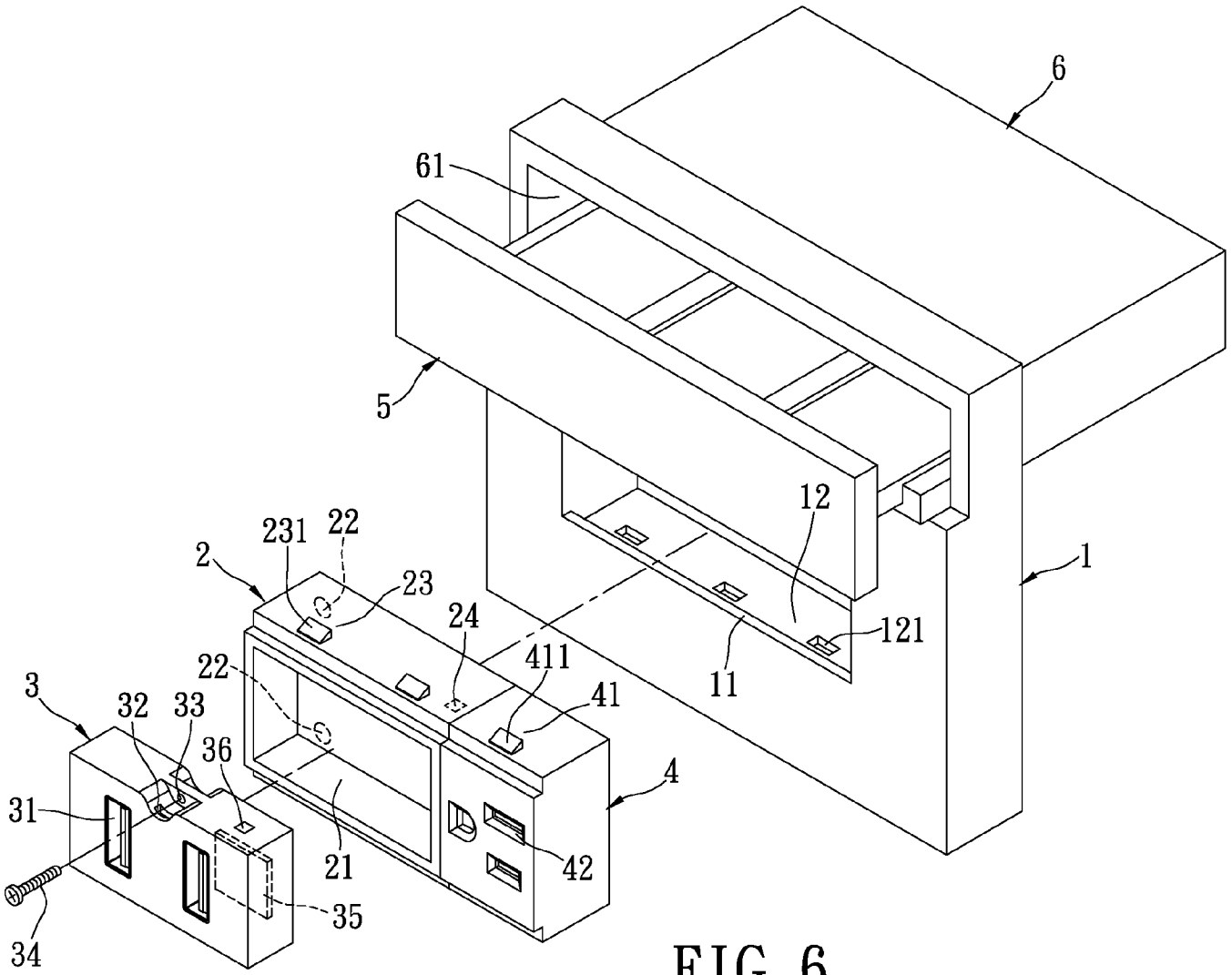
FIG. 6 illustrates an exploded view of a modular electrical connector module in accordance with a fourth embodiment of the instant disclosure.

Please refer to FIG. 6. In the instant embodiment, the outer panel 1 also includes a cabinet structure 6 having a tray opening 61 and the carrying tray 5 is movably disposed therein. When the cabinet structure 6 is pulled out, electronic products can be put thereon. The carrying tray 5 is drawn into the cabinet structure 6 when not in use.

Fifth Embodiment

Figure 7:
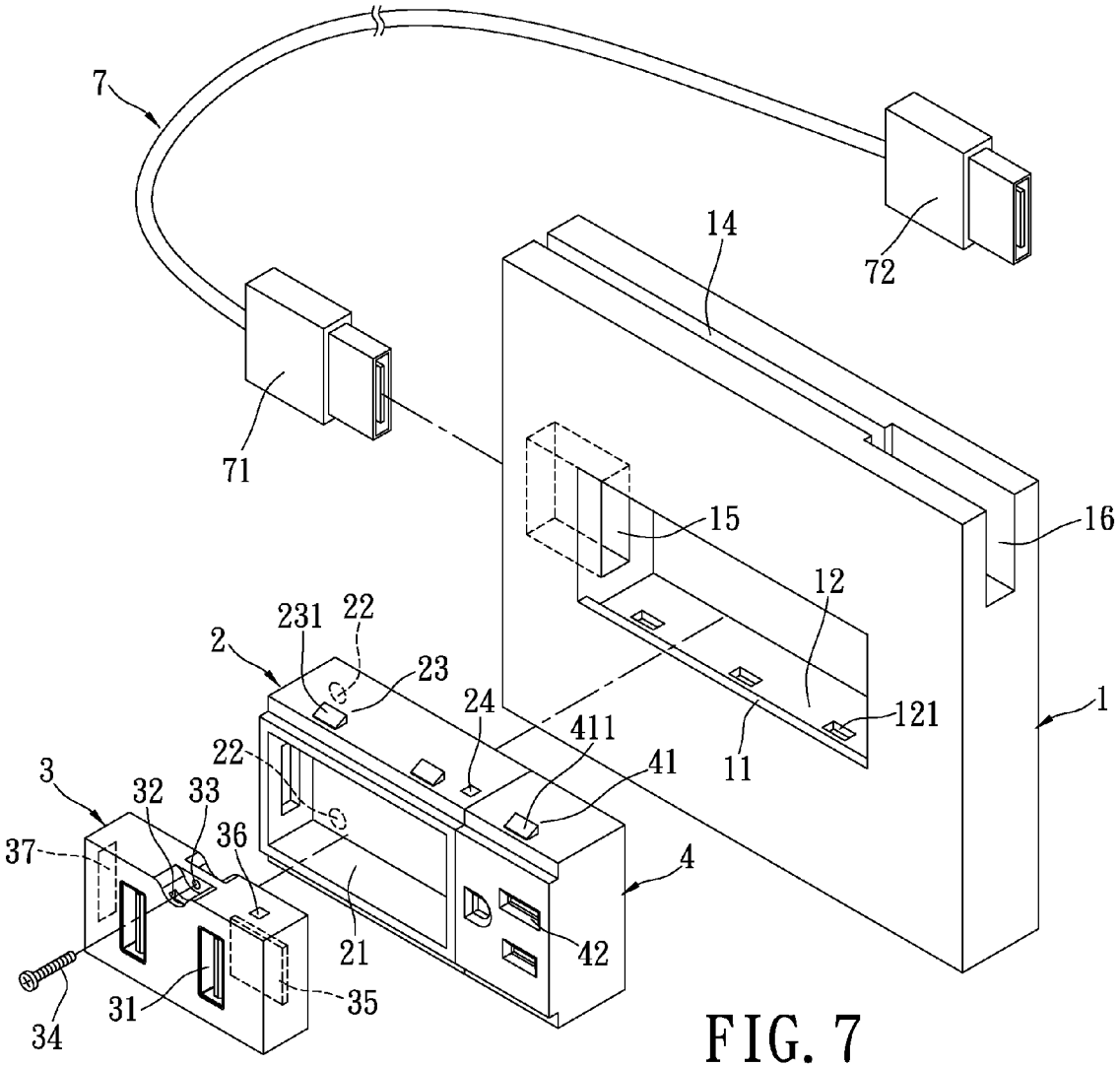
FIG. 7 illustrates an exploded view of a modular electrical connector module in accordance with a fifth embodiment of the instant disclosure.

Please refer to FIG. 7. In the instant embodiment, a cable 7 electrically connects the interchangeable socket module 3 at one end and may be held along the edge of the outer panel 1.

The outer panel 1 may further include a cable groove 14 to accommodate the cable 7 along the edge of the outer panel 1. One end of the cable 7 is a plug 71, which can be adapted to USB, IEEEE 1394, HDMI connectors, AV and DC terminals. The other end of the cable 7 is a connector 72 which can be adapted to a wide variety of connectors as well. The outer panel 1 also includes a plug slot 15 and a connector slot 16 accommodating the two ends of the cable 7 respectively. The plug and connector slots 15, 16 are jointed by the cable groove 14. The placement of cable 7 in the groove and slots provides tidier organization.

The interchangeable socket module 3 includes a connector bridge 37 corresponding to the plug slot 15. The connector bridge 37 can be adapted to a variety of connectors associated with the plug 71. When the plug 71 rests in the plug slot 15, the connector bridge 37 allows electrical connection between the interchangeable socket module 3 and the plug 71. The connector bridge 37 further enhances the engagement of the cable 7 to the outer panel 1. Alternatively, the cable 7 may electrically connect the socket unit 4 instead of the interchangeable socket module 3.

In the instant embodiment, the outer panel 1 retains the cable 7 in mobility. In use, the cable 7 along with the connector 72 can be retrieved immediately from the cable groove 14 and connector slot 16. In contrast, when the cable 7 is not in use, the cable 7 and the connector 72 rest along the edge of outer panel 1, thus reducing storage space and allowing quick access.

The interchangeable socket module 3 possesses the same properties as the aforementioned embodiment.

Sixth Embodiment

Figure 8:
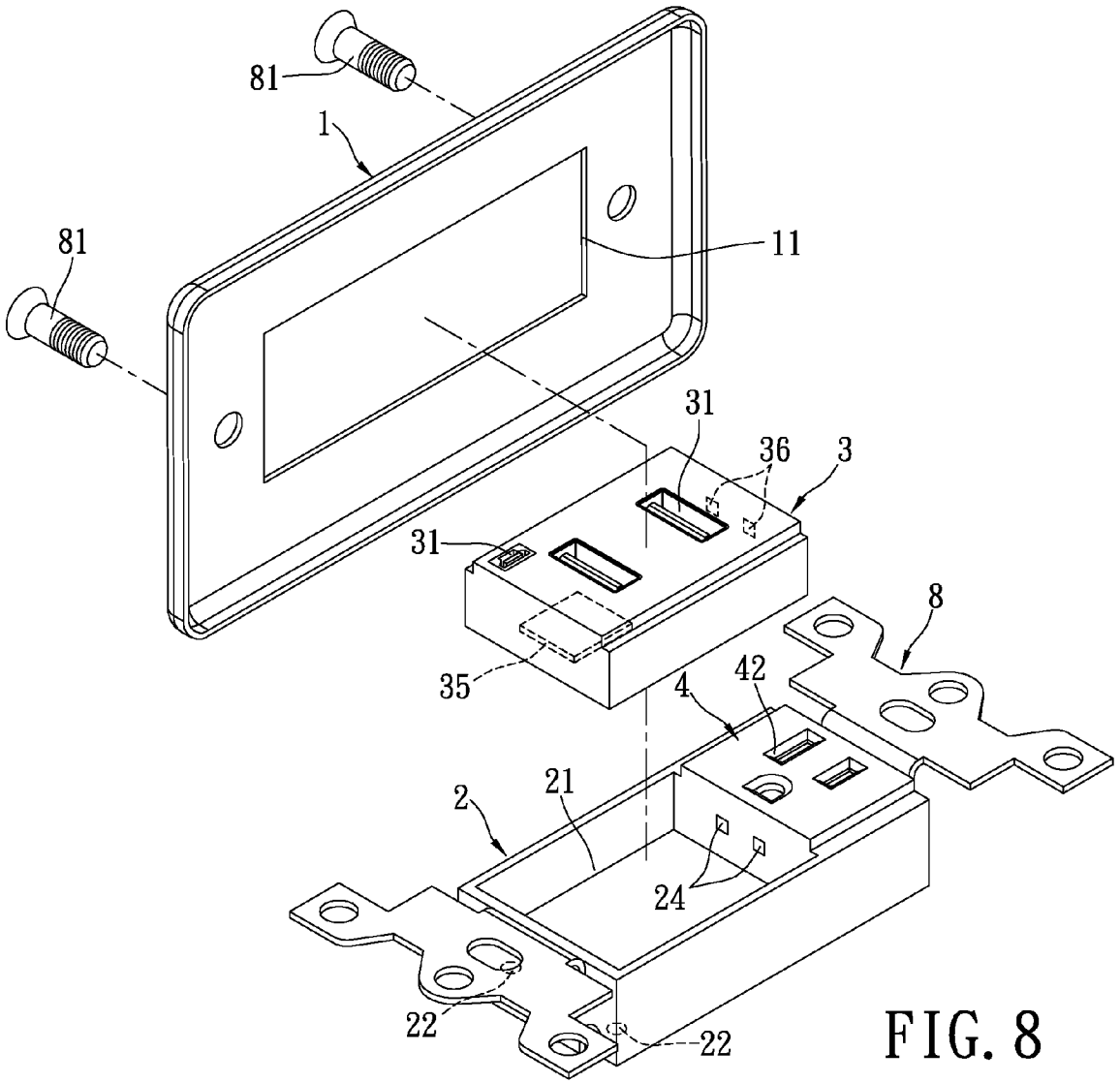
FIG. 8 illustrates an exploded view of a modular electrical connector module in accordance with a sixth embodiment of the instant disclosure.
Figure 9:
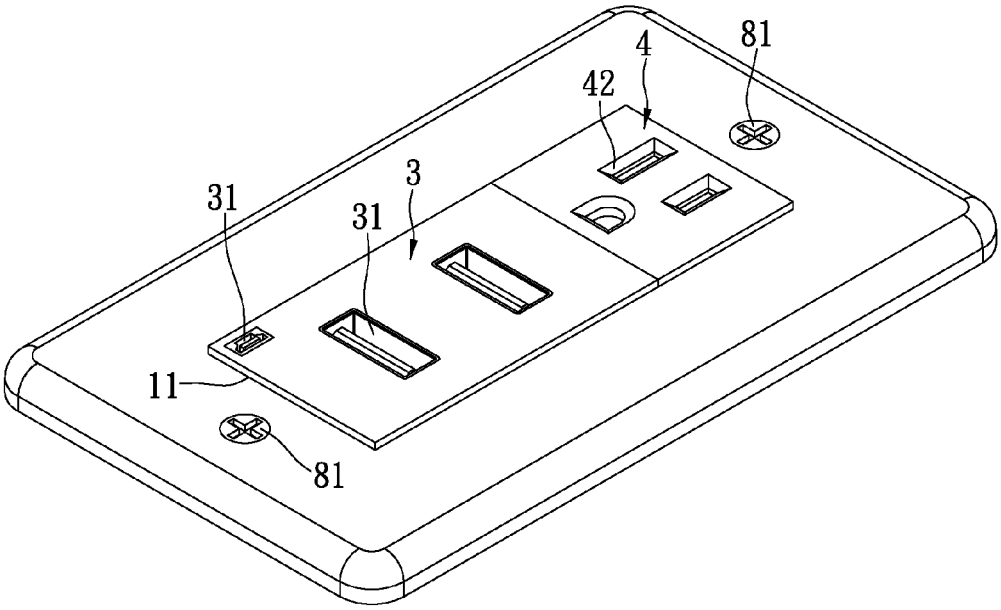
FIG. 9 illustrates a perspective view of a modular electrical connector module in accordance with a sixth embodiment of the instant disclosure.

Please refer to FIG. 8 in conjunction with FIG. 9. In the instant embodiment, the interchangeable socket module 3 includes a plurality of exterior electrical contacts 36 and the socket unit 4 includes a plurality of corresponding exterior electrical contacts 24. In other words, the electrical contacts 24, 36 physically contacts, thus allowing electrical connection there-between. In addition, the interchangeable socket module 3 is demountable from the outlet box 2, whereas the outer panel 1 abuts the edge of the interchangeable socket module 3 on either side to lock the interchangeable socket module 3 in the outlet box 2. In other words, the interchangeable socket module 3 cannot be removed from the outlet box 2 directly unless the outer panel 1 is displaced firstly. The interchangeable socket module 3 also includes another type of connector 31 (for example, mini USB connector) in the instant embodiment.

Seventh Embodiment

Figure 10:
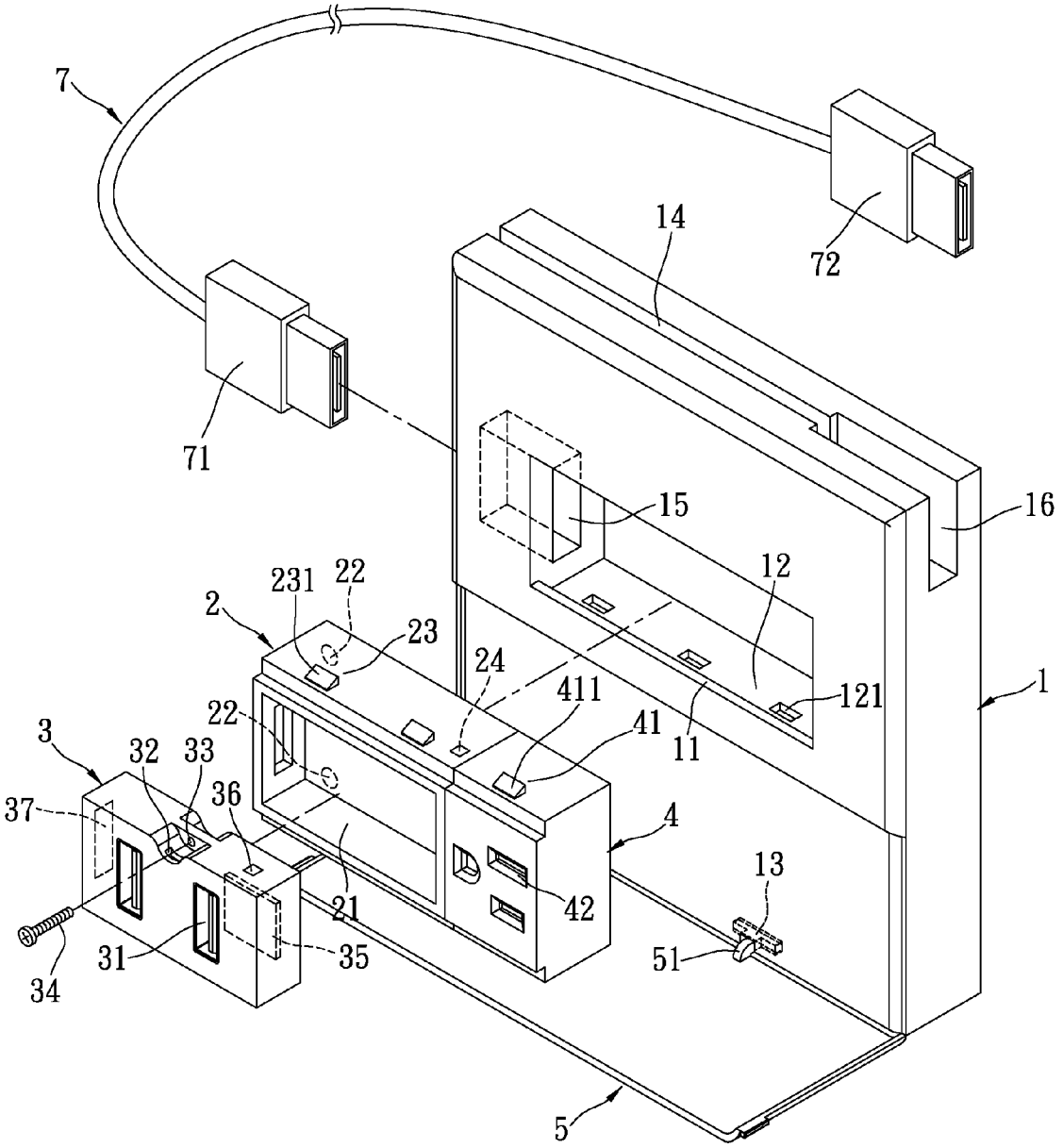
FIG. 10 illustrates an exploded view of a modular electrical connector module in accordance with a seventh embodiment of the instant disclosure.

Please refer to FIG. 10. In the instant embodiment, the outer panel 1 includes a carrying tray 5 which is capable of flipping to different angles in relation to the outer panel 1.

Eighth Embodiment

Figure 11:
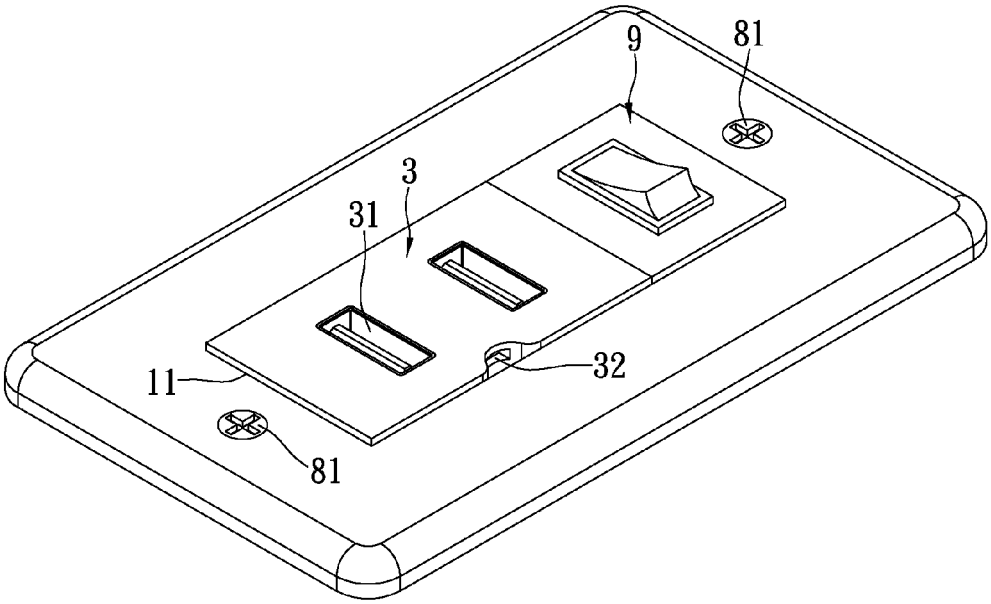
FIG. 11 illustrates a perspective view of a modular electrical connector module in accordance with an eighth embodiment of the instant disclosure.

Please refer to FIG. 11. In the instant embodiment, the socket unit 4 is replaced by a switch 9 mounted in the outlet box 2 yet detachable. The switch 9 is exposed to the exterior via the opening 11.

Ninth Embodiment

Figure 12:
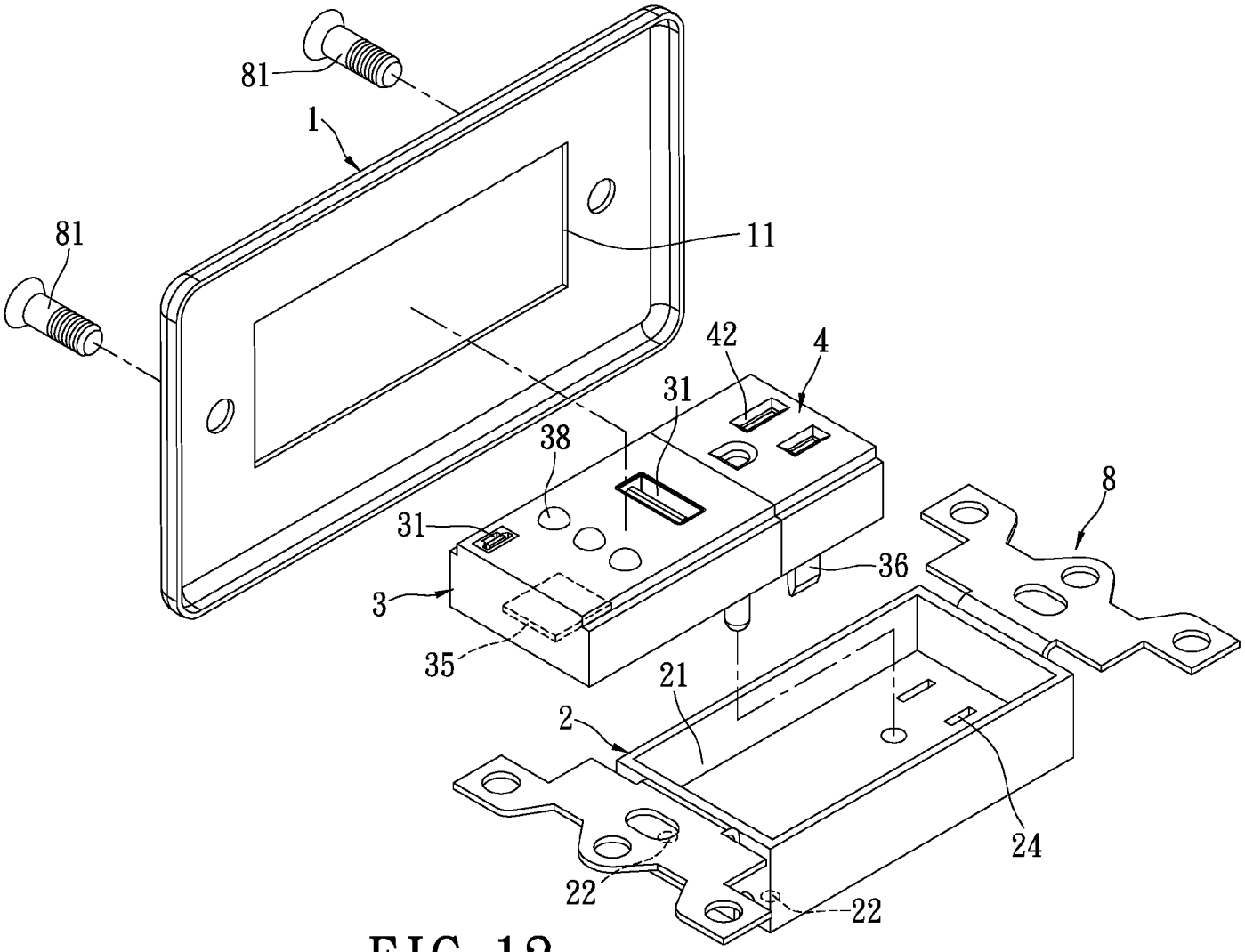
FIG. 12 illustrates an exploded view of a modular electrical connector module in accordance with a ninth embodiment of the instant disclosure.

Please refer to FIG. 12. In the instant embodiment, the socket unit 4 is demountable from the outlet box 2 and exposed to the exterior via the opening 11. The interchangeable socket module 3 includes at least one illumination unit 38 (for example, light-emitting diodes) to indicate the status. The electrical contacts 24, 36 may be arranged on the outlet box 2 and the socket unit 4 respectively in different formats, for example, prongs. The outer panel 1 and the outlet box 2 can combine to form a one piece structure (not shown in the figure). Alternatively, the outer panel 1 can be completely omitted.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A modular electrical connector module for mounting to a wall, comprising:

an outer panel defining an opening;

an outlet box coupled to the outer panel from an inner side thereof and accessible through the opening;

an interchangeable socket module including at least one connector replaceably disposed in the outlet box and demountable via the opening; and a socket unit demountably disposed in the outlet box and exposed to the exterior via the opening;

wherein the interchangeable socket module and the outlet box each respectively include an electrical contact correspondingly arranged to be in direct physical contact with one another such that the interchangeable socket module is electrically connected to the outlet box by physically contacting the electrical contacts without any wires there-between;

wherein the outlet box has a concave receiving portion formed therein, and a shape of the concave receiving portion is corresponding to that of the interchangeable socket module such that the interchangeable socket module is securely received in the concave receiving portion and exposed to the opening for an electrical plug to be plugged into;

wherein a dimension of the interchangeable socket module is smaller than that of the opening such that the interchangeable socket is retrieved directly from the outlet box without removing the outer panel.

2. The modular electrical connector module for mounting to a wall according to claim 1, further comprising a socket unit, the outlet box and the socket unit engages with the outer panel by a pair of brackets and screws.

3. The modular electrical connector module for mounting to a wall according to claim 1, wherein the outlet box includes a wire passage at rear end.

4. The modular electrical connector module for mounting to a wall according to claim 1, wherein the interchangeable socket module is formed with a recess.

5. The modular electrical connector module for mounting to a wall according to claim 1, wherein the interchangeable socket module is a charger including a charging circuit electrically connecting the connector.

6. The modular electrical connector module for mounting to a wall according to claim 1, wherein the outer panel is the physical extension from the outlet box.

7. A modular electrical connector module for mounting to a wall, comprising:

an outer panel defining an opening;

an outlet box coupled to the outer panel from an inner side thereof and accessible through the opening;

an interchangeable socket module including at least one connector replaceably disposed in the outlet box and demountable via the opening; and a cabinet structure arranged on the inner side of the outer panel and having a tray opening and a carrying tray slidably disposed therein, wherein the carrying tray is selectively arranged between a received position and an extended position;

wherein the interchangeable socket module and the outlet box each respectively include an electrical contact correspondingly arranged to be in direct physical contact with one another such that the interchangeable socket module is electrically connected to the outlet box by physically contacting the electrical contacts without any wires there-between;

wherein the outlet box has a concave receiving portion formed therein, and a shape of the concave receiving portion is corresponding to that of the interchangeable socket module such that the interchangeable socket module is securely received in the concave receiving portion and exposed to the opening for an electrical plug to be plugged into;

wherein a dimension of the interchangeable socket module is smaller than that of the opening such that the interchangeable socket is retrieved directly from the outlet box without removing the outer panel.

8. A modular electrical connector module for mounting to a wall, comprising:

an outer panel defining an opening;

an outlet box coupled to the outer panel from an inner side thereof and accessible through the opening;

an interchangeable socket module including at least one connector replaceably disposed in the outlet box and demountable via the opening; and a cable and a connector, the cable electrically connects the interchangeable socket module from one end and the connector the other end, and the outer panel further includes a cable groove for reelingly receiving the cable;

wherein the interchangeable socket module and the outlet box each respectively include an electrical contact correspondingly arranged to be in direct physical contact with one another such that the interchangeable socket module is electrically connected to the outlet box by physically contacting the electrical contacts without any wires there-between;

wherein the outlet box has a concave receiving portion formed therein, and a shape of the concave receiving portion is corresponding to that of the interchangeable socket module such that the interchangeable socket module is securely received in the concave receiving portion and exposed to the opening for an electrical plug to be plugged into;

wherein a dimension of the interchangeable socket module is smaller than that of the opening such that the interchangeable socket is retrieved directly from the outlet box without removing the outer panel; and wherein the outer panel is formed with an embedded plug slot to accommodate the other end of the cable, and the interchangeable socket module includes a connector bridge electrically connecting the end of the cable to the interchangeable socket module.

* * * * *